US007152590B2

(12) United States Patent
Samo et al.

(10) Patent No.: US 7,152,590 B2
(45) Date of Patent: Dec. 26, 2006

(54) SUPERSTRUCTURE OF ENGINE

(75) Inventors: Junichi Samo, Osaka (JP); Katsuyuki Shiota, Osaka (JP); Yasuhiro Kanazu, Osaka (JP); Shinji Nishimura, Osaka (JP); Masashi Sagara, Osaka (JP)

(73) Assignee: Yanmar Co., Ltd. (JP)

( * ) Notice: Subject to any disclaimer, the term of this patent is extended or adjusted under 35 U.S.C. 154(b) by 0 days.

(21) Appl. No.: 11/219,868

(22) Filed: Sep. 7, 2005

(65) Prior Publication Data

US 2006/0048726 A1 Mar. 9, 2006

Related U.S. Application Data

(63) Continuation of application No. PCT/JP2004/001671, filed on Feb. 16, 2004.

(30) Foreign Application Priority Data

Mar. 11, 2003 (JP) ..... 2003-065290
Mar. 11, 2003 (JP) ..... 2003-065291
Mar. 11, 2003 (JP) ..... 2003-065337

(51) Int. Cl.
*F01P 1/02* (2006.01)
*F02B 77/04* (2006.01)
*F02B 31/00* (2006.01)
*F02B 25/06* (2006.01)

(52) U.S. Cl. ..... 123/572; 123/41.7; 123/306; 123/198 E

(58) Field of Classification Search ..... 123/198 E, 123/41.7, 572, 306
See application file for complete search history.

(56) References Cited

U.S. PATENT DOCUMENTS 1,977,127 A * 10/1934 Guernsey ..... 123/263
3,646,731 A * 3/1972 Hansen ..... 123/520
3,824,971 A * 7/1974 Sakatsche et al. ..... 123/302
4,438,733 A * 3/1984 Sasaki ..... 123/198 E
5,161,490 A * 11/1992 Iwata et al. ..... 123/41.7
5,377,632 A * 1/1995 Aronsson et al. ..... 123/198 E
5,569,311 A 10/1996 Oda et al.
5,813,384 A * 9/1998 Lavender et al. ..... 123/198 E

FOREIGN PATENT DOCUMENTS

JP 53-153115 12/1978

(Continued)

*Primary Examiner*—Noah P. Kamen
(74) *Attorney, Agent, or Firm*—Sterne, Kessler, Goldstein & Fox P.L.L.C.

(57) ABSTRACT

With regard to a construction that a fan 41 is provided at one side of an engine 1 and covered by a fan casing 45, and an air cleaner 30 is arranged near the fan casing 45 and at a side of a cylinder head 5 on which an intake port 5*a* is disposed, a suction port 31*a* communicated with the inside of the fan casing 45 is provided in a main body 31 of the air cleaner 30. A barrier 46 is provided at a position facing to the suction port 31*a* in the air cleaner 30. A wall standing toward the fan casing 45 and the cylinder head 5 is formed on the outer surface of the main body 31 of the air cleaner 30. An air intake part is provided on one of side surfaces of a cover body 32 of the air cleaner 30 and the cover body 32 is constructed to be an equilateral polygon. An intake pipe 31*k* communicating the air cleaner 30 with the intake port 5*a* of the cylinder head 5 is constructed integrally with a main body 31 of the air cleaner 30.

24 Claims, 14 Drawing Sheets

FOREIGN PATENT DOCUMENTS

| | | | |
|---|---|---|---|
| JP | 55-73544 | | 5/1980 |
| JP | 61-106968 | | 5/1986 |
| JP | 62-88874 | | 4/1987 |
| JP | 62071511 | A * | 4/1987 |
| JP | 63045423 | A * | 2/1988 |

* cited by examiner (a)

(b)

(a)

(b)

SUPERSTRUCTURE OF ENGINE

CROSS-REFERENCE TO RELATED APPLICATION

The present application is a Continuation of PCT Application No. PCT/JP2004/001671, filed Feb. 16, 2004, which is incorporated in its entirety herein by reference thereto.

BACKGROUND OF THE INVENTION

1. Field of the Invention

The present invention relates to a superstructure of an engine. In detail, the present invention relates to a construction of an air cleaner cleaning air going to a combustion chamber of the engine, a construction of breather provided in an upper portion of a rocker arm casing, and a construction from the air cleaner and breather to an air intake part in a cylinder head.

2. Background Art

Conventionally, an air cleaner cleaning air going to a combustion chamber is provided in an upper portion or the like of an engine, and the air cleaner introduces and cleans outside air, and the cleaned air is supplied to the combustion chamber as combustion air.

With regard to the air cleaner, an air intake part is provided in a cover body which is a component member of the air cleaner so that outer air is sucked directly into the air cleaner through the air intake part. Otherwise, as disclosed in the Japanese Utility Model Laid Open Gazette Hei. 5-50061 for example, the air intake part of the air cleaner is connected to another device having an air cooling mechanism so that air cooled by the device is introduced into the air cleaner through a duct and the air intake part. Accordingly, combustion air is introduced into the engine.

However, as the above mentioned, in the case of introducing outer air directly through the air intake part provided in the air cleaner, if the engine is arranged in a closed cabinet, the heat of the engine itself may prevent the introduction of cool air. Furthermore, with regard to the above-mentioned art disclosed in the Japanese Utility Model Laid Open Gazette Hei. 5-50061, the air cooling mechanism and the air cleaner are connected to each other through the duct, whereby part number increases and the cost increases.

The air cleaner is attached to an intake port provided in a cylinder head of the engine through an intake pipe. With regard to such an air cleaner, there is an art that the air cleaner is attached to an optional position by changing the length of shape of the intake pipe and air cleaned by the air cleaner is introduced into the intake port through the intake pipe.

However, with regard to the air cleaner attached to the intake port provided in the cylinder head of the engine through the intake pipe, as disclosed in the Japanese Patent Laid Open Gazette 2001-73897 for example, the air cleaner and the intake pipe are constructed separately, whereby part number increases and the cost increases. Furthermore, the air cleaner is attached to the cylinder head through the intake pipe, therefore it is difficult to make the construction compact.

Incidentally, a breather is also provided conventionally in the upper portion of the engine that a breather chamber is provided in a rocker arm chamber covering the upper portion of the cylinder head so as to adjust pressure between the inside of the rocker arm chamber and the outside and to separate blowby gas including oil mist into a gas component and an oil component for preventing the oil mist from being discharged to the outside. The breather chamber of the breather comprises a space surrounded by the side wall of the rocker arm chamber (breather casing) and a base plate provided for a fixed interval against the reverse face of the rocker arm chamber, and oil in the blowby gas is trapped by a filter gauze or the like disposed in the breather chamber. With regard to such a breather, as disclosed in the Japanese Utility Model Laid Open Gazette Hei. 6-4311 for example, there is an art that the side wall of the breather casing and the base plate are formed integrally with each other so as to reduce part number and assemble process and to improve productivity, thereby solving the generation of noise caused by the vibration of the engine.

There is a breather provided therein with a check valve preventing pressure in the rocker arm chamber from increasing. With regard to such a breather having a check valve, gas with high pressure passes through the check valve preventing back flow and returns to the intake, port. Lubricating oil is accumulated in the breather chamber of the breather scattering in the rocker arm chamber, and when the lubricating oil is accumulated for a certain amount, the lubricating oil adheres to the vicinity of the check valve and goes out through the check valve, whereby the gas including the lubricating oil returns to the intake port. If the amount of the lubricating oil is small, the oil is not very influential. However, if the amount of the lubricating oil sucked through the inlet of the check valve increases, the lubricating oil burns in the combustion chamber so as to generate exhaust emission, thereby spoiling the exhaust. For preventing the immersion of the lubricating oil causing the exhaust emission, a baffle is provided around the air hole of the breather.

However, such a baffle forms a substantial cylindrical space with the wall surface of the rocker arm chamber, and when the breather chamber is filled with lubricating oil more than a fixed amount, the engine is slanted or vibrated in the case of mounting the engine on a vehicle so as to vibrate the surface of the accumulated lubricating oil, whereby the lubricating oil may be sucked.

On the other hand, at low temperature, such as in the winter or at a cold district, the temperature of air is low and mixed gas in the combustion chamber is not raised to the combustion temperature easily, whereby the engine may not start easily. Therefore, conventionally, with regard to a diesel engine, for raising compression ratio so as to make the mixed gas easy to burn, a passage for injecting starting adjuvant such as oil, communicated with the intake port is provided in the upper portion of the engine, and the starting adjuvant is injected through the passage so as to enter the combustion chamber through the intake port. Accordingly, the compression ratio is raised for the amount of the starting adjuvant introduced into the combustion chamber, whereby the mixed gas becomes easy to burn and the engine becomes easy to start. Such an art for improving starting ability of the engine is well known.

However, with regard to the starting adjuvant injection passage with the conventional shape, some users may introduce oil more than a fixed amount at the time of introducing the oil as the starting adjuvant. Thereupon, excessive oil enters the combustion chamber so as to cause oil hammer, whereby a connecting rod or the like may be broken. When the starting adjuvant injection passage is provided separately, the cost increases.

Therefore, with regard to the superstructure of the engine, the purpose of the present invention is to improve the attachment construction of the air cleaner that cool air can be sucked into the air cleaner in the case of arranging the engine in a closed cabinet, and to connect the air cleaner to the air cooling mechanism with a simple structure so as to reduce part number and to reduce the cost, thereby realizing a compact construction.

With regard to the breather, the purpose of the present invention is to contrive the shape of the baffle provided around the air hole (inlet) of the breather so as to prevent lubricating oil accumulated in the breather chamber from being sucked through the air hole, thereby preventing the exhaust emission caused by the lubricating oil sucked through the air hole. Furthermore, with regard to the starting adjuvant injection passage, the purpose of the present invention is to contrive the shape thereof so that even a general user can inject the starting adjuvant finely, thereby preventing overrun and oil hammer. Moreover, with regard to the breather and the starting adjuvant injection passage, the purpose of the present invention is to arrange them intensively in the upper portion of the engine so as to provide a compact superstructure of the engine.

SUMMARY OF THE INVENTION

According to the present invention, with regard to a superstructure of an engine that a fan is provided at one side of the engine and covered by a fan casing, and an air cleaner is arranged near the fan casing, a suction port opening into the fan casing is provided in a main body of the air cleaner. Accordingly, the suction port of the fan casing for outside air serves not only as an inlet for cooling air for the engine but also as a suction port for combustion air to the air cleaner. Namely, for example, in the case that the engine is arranged in a closed cabinet (the case of a soundproof engine), it is necessary to provide only one suction port, whereby the suction passage can be designed easily, and it is easy to set the suction port to a position through which the cleanest and coolest air can be supplied.

Since the air in the fan casing can be guided directly to the air cleaner, the air intake system can be unified into a compact construction. Then, by guiding the air sucked into the fan casing to the air cleaner, the air with little dust can be sucked into the air cleaner, thereby expanding the lifetime of the element of the air cleaner.

Furthermore, regardless whether a normal engine or a soundproof engine is disposed, the common air cleaner can be used, whereby the variety of the air cleaner can be reduced so as to reduce the cost.

According to the present invention, a barrier is provided at a position facing to the suction port so as to disperse sucked air. Accordingly, air sucked through the suction port strikes against the barrier and is dispersed so as not to strike directly against the element facing to the suction port but to be guided to be spread over the element. Therefore, the inclination of air suction to the element can be prevented. Accordingly, it is prevented that a part of the element is only obstructed or that a part of the element is only degraded, thereby expanding the lifetime of the element.

According to the present invention, the air cleaner is arranged at a side of a cylinder head and a wall standing toward the cylinder head is formed on an outer surface of the main body of the air cleaner. Accordingly, the wall is constructed integrally with the main body so as to serve as baffles, therefore it is not necessary to provide any baffle so as to guide air from the fan to the cylinder head, thereby reducing the cost.

According to the present invention, with regard to a superstructure of an engine that an air cleaner is provided which is constructed by housing an element by a main body and a cover body, a recess along an outer perimeter of the element is formed on an inner surface of the main body. Accordingly, at the time of attaching the element to the main body, it is easily able to hold the element by the recess formed on the main body so as to position the element before fastening the element to the main body by a bolt and a nut. Accordingly, the element can be prevented from being attached to a wrong position, and the air cleaner can be assembled easily and quickly.

According to the present invention, with regard to a superstructure of an engine that an air cleaner is provided which is constructed by housing an element by a main body and a cover body, an air intake part is provided on one of side surfaces of the cover body and the cover body is constructed to be an equilateral polygon. Accordingly, the attachment direction of the cover body can be changed by rotating the cover body for fixed degree so as to change the direction of the air intake part. Since the direction of the air intake part can be changed inversely by changing the attachment direction of the cover body, the spec of the engine can be changed easily.

According to the present invention, with regard to a superstructure of an engine that an air cleaner is attached to an intake port of a cylinder head of the engine, an intake pipe communicated with the intake port is constructed integrally with a main body of the air cleaner. Accordingly, it is not necessary to attach an intake pipe to an air cleaner conventionally, whereby the part number can be reduced so as to reduce the cost. Furthermore, the main body including the intake pipe can be manufactured easily by die casting or injection molding, thereby reducing the cost. Moreover, the width (in the direction of the intake pipe) of the main body can be shortened. Accordingly, in the case of constructing the air cleaner in the size similar to the conventional one, the element can be enlarged for the shortening of the main body, thereby expanding the lifetime of the element.

According to the present invention, a suction port, communicated with an inside of a fan casing positioned near the air cleaner, is provided in the main body. Accordingly, the suction port of the fan casing for outside air serves not only as an inlet for cooling air for the engine but also as a suction port for combustion air to the air cleaner. Namely, for example, in the case that the engine is arranged in a closed cabinet (the case of a soundproof engine), it is necessary to provide only one suction port, whereby the suction passage can be designed easily, and it is easy to set the suction port to a position through which the cleanest and coolest air can be supplied.

Since the air in the fan casing can be guided directly to the air cleaner, the air intake system can be unified into a compact construction. Then, by guiding the air sucked into the fan casing to the air cleaner, the air with little dust can be sucked into the air cleaner, thereby expanding the lifetime of the element of the air cleaner.

Furthermore, regardless whether a normal engine or a soundproof engine is disposed, the common air cleaner can be used, whereby the variety of the air cleaner can be reduced so as to reduce the cost.

According to the present invention, a wall, formed on an outer surface of the main body of the air cleaner, stands toward a fan casing positioned near the air cleaner and the engine. Accordingly, the wall is constructed integrally with the main body so as to serve as baffles, therefore it is not necessary to provide any baffle so as to guide air from the fan to the cylinder head, thereby reducing the cost.

According to the present invention, the main body is formed by a two-part mold, and a suction hole provided in the main body is formed perpendicular to draft direction of the mold by adhering two molds with each other. Accordingly, the main body can be formed easily by aluminum die casting. The suction port can be formed simultaneously with the main body by the mold, whereby the boring work is omitted so as to reduce the cost.

According to the present invention, a suction hole of intake pipe is formed to be an extension of the intake port of the cylinder head. Accordingly, the air flow from the air cleaner through the suction hole to the intake port is smooth and turbulence is prevented from being generated in the suction passage so as to supply air from the air cleaner to the intake port stably. Accordingly, resistance of air, introduced from the intake port, in the suction passage is made small so as to promote swirls formed at the time that the air flows from the valve hole of the intake valve into the cylinder.

According to the present invention, with regard to a superstructure of an engine comprising a breather in an upper portion of a rocker arm chamber, a baffle is provided around an air hole of the breather in the rocker arm casing, and a slit is provided so as to open a lower portion of the baffle. Accordingly, even if lubricating oil accumulated in the rocker arm chamber reaches the lower end of the baffle, air can be vented through the slit provided in the baffle, thereby preventing the lubricating oil accumulated in the rocker arm chamber from sucked through the air hole. Namely, unless the rocker arm chamber is filled with lubricating oil, the lubricating oil is prevented from entering through the air hole. Accordingly, the generation of exhaust emission, caused by the lubricating oil, is prevented, thereby improving exhaust ability. The slit can be formed easily, whereby the above-mentioned effect can be obtained with a simple construction without providing a cavity by drilling instead of the slit.

According to the present invention, a reflux passage of the breather and a starting adjuvant injection passage are constructed integrally with a rocker arm casing of the rocker arm chamber. Accordingly, the breather and the starting adjuvant injection part are arranged intensively in the rocker arm casing, whereby part number is reduced so as to reduce the cost and to simplify the processing and the space is saved.

According to the present invention, with regard to a superstructure of an engine comprising a breather in an upper portion of a rocker arm chamber, a reflux passage of the breather and a starting adjuvant injection passage are communicated with each other, and a throttle is provided in the starting adjuvant injection passage. Accordingly, at the time of injecting oil as a starting adjuvant, the injection amount of the starting adjuvant is limited automatically by the throttle provided in the injection passage thereby preventing excessive injection. The injection amount of the starting adjuvant is limited and the starting adjuvant is injected gradually, therefore even a general user can inject the starting adjuvant while checking the amount by eye, thereby preventing that much oil is sucked into the combustion chamber at once so as to cause overrun or oil hammer.

According to the present invention, with regard to a superstructure of an engine that air is sucked into an intake port provided in a cylinder head covering an upper portion of a cylinder block, and the air is supplied through an intake valve arranged below the intake port in the cylinder head to a combustion chamber, an inner surface of an outside of the intake port is formed close along a direction of a tangential line of an inner perimeter of a cylinder liner of the cylinder block when viewed in plan. Accordingly, the resistance of air flowing into the intake port from the outside becomes smallest, whereby the flow velocity of the outside air becomes fast. Therefore, the difference of flow velocity of sucked air between the inside and outside of the intake port becomes large so that the swirls of air flow tend to be generated. Namely, according to the shape of the intake port as the above, it is easy not to prevent air flow as well as possible so as to generate strong swirls, whereby combustion efficiency is improved and air and fuel are mixed well so as to promote the combustion.

BRIEF DESCRIPTION OF THE DRAWINGS/FIGURES

DETAILED DESCRIPTION OF THE INVENTION

Figure 1:
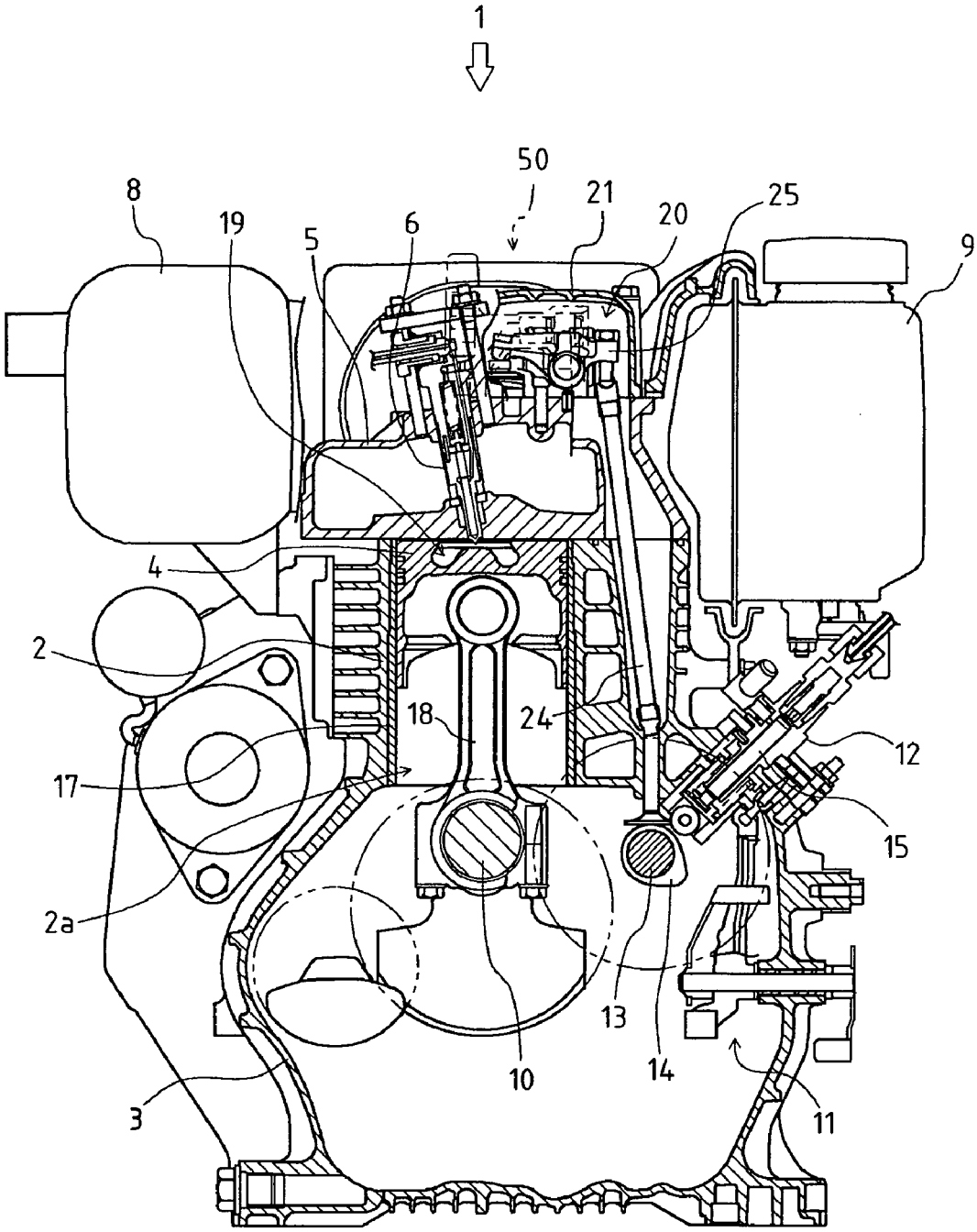
FIG. 1 is a sectional front view of an engine.

Firstly, explanation will be given on the entire construction of an engine 1 according to FIGS. 1 to 3.

The upper portion of the main body of the engine 1 comprises a cylinder block 2 and the lower portion thereof comprised a crankcase 3. A cylinder 2*a* is formed vertically at the center of the cylinder block 2, and a piston 4 is vertically slidably housed in a cylinder liner 17 in the cylinder 2*a*. Below the cylinder block 2, a crankshaft 10 is pivotally supported longitudinally by the crankcase 3, and the crankshaft 10 and the piston 4 are connected to each other through a connecting rod 18.

The upper portion of the cylinder block 2 is covered by a cylinder head 5. In the cylinder head 5, an intake valve 22, an exhaust valve 23 and a fuel injection nozzle 6 are arranged. A space above the cylinder head 5 is covered by a rocker arm casing 21 so as to construct a rocker arm chamber 20. A muffler 8 is arranged at one of sides of the rocker arm casing 21, and a fuel tank 9 is arranged at the other side thereof. The fuel injection nozzle 6 is separated between the intake valve 22 and the exhaust valve 23 by the rocker arm casing 21, and the front portion (discharge part) of the fuel injection nozzle 6 is inserted into a combustion chamber 19 formed in the center of the upper portion of the cylinder 2*a* so as to inject fuel into the combustion chamber 19.

The rocker arm chamber 20 is disposed therein with the upper ends of the intake valve 22 and the exhaust valve 23, upper ends of an intake push rod 24 and an exhaust push rod (not shown), rocker arms 25 and 26, and the attachment part of the fuel injection nozzle 6, and is provided therein with a later-discussed breather 50.

A governor 11 is arranged in the crankcase 3, and a fuel injection pump 12 is arranged above the governor 11. The fuel injection pump 12 absorbs fuel from the fuel tank 9 by moving a plunger 15 reciprocatingly in the fuel injection pump 12, and supplies the fuel of predetermined quantity to the fuel injection nozzle 6 at predetermined intervals so as to inject the fuel from the fuel injection nozzle 6 to the combustion chamber 19. At this time, Power of the crankshaft 10 is transmitted to a camshaft 13 through a gear provided on the crankshaft 10 so as to rotate a cam 14 provided on the camshaft 13, whereby the plunger 15 is moved reciprocatingly.

Figure 2:
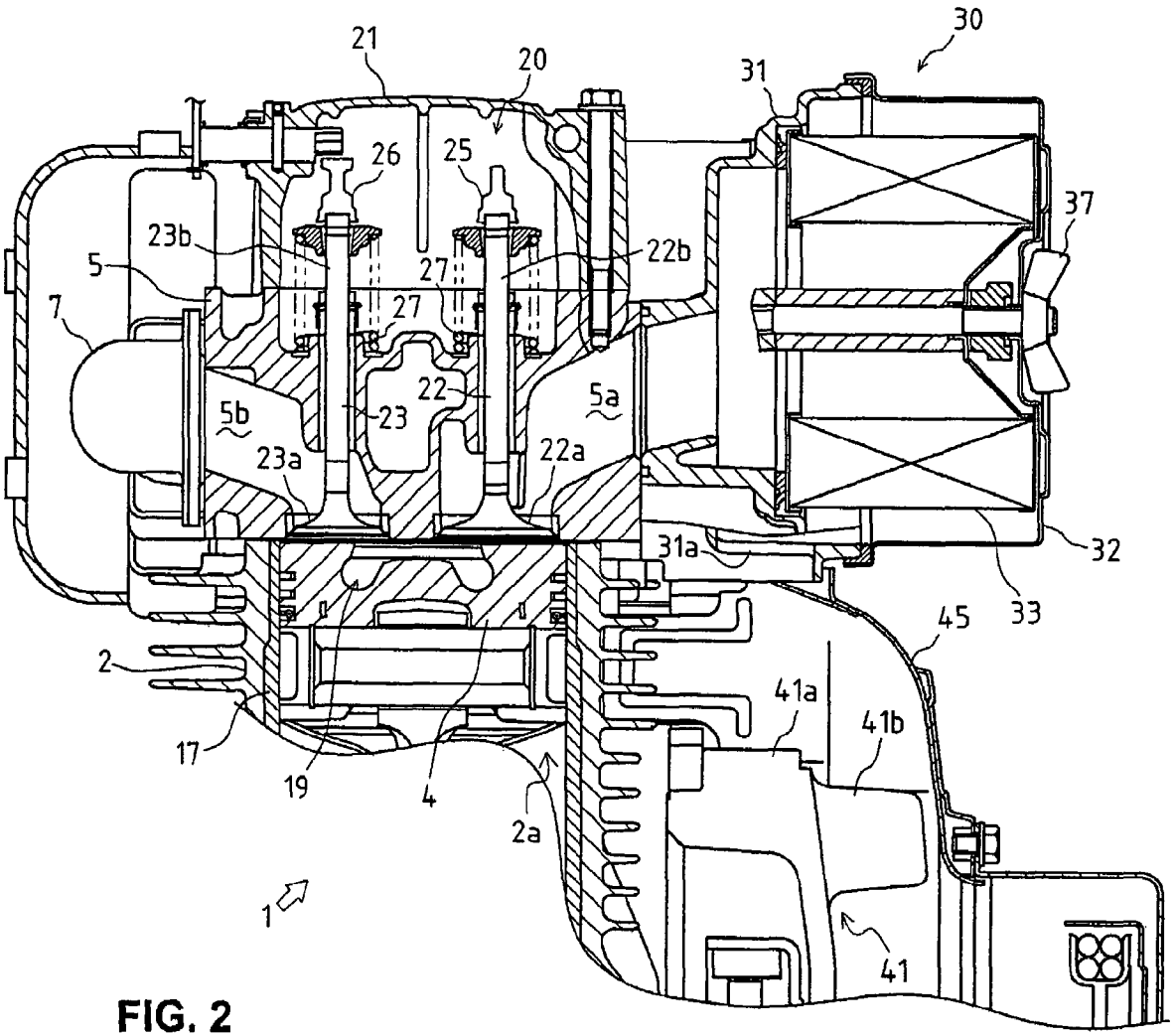
FIG. 2 is a sectional side view of the engine.
Figure 3:
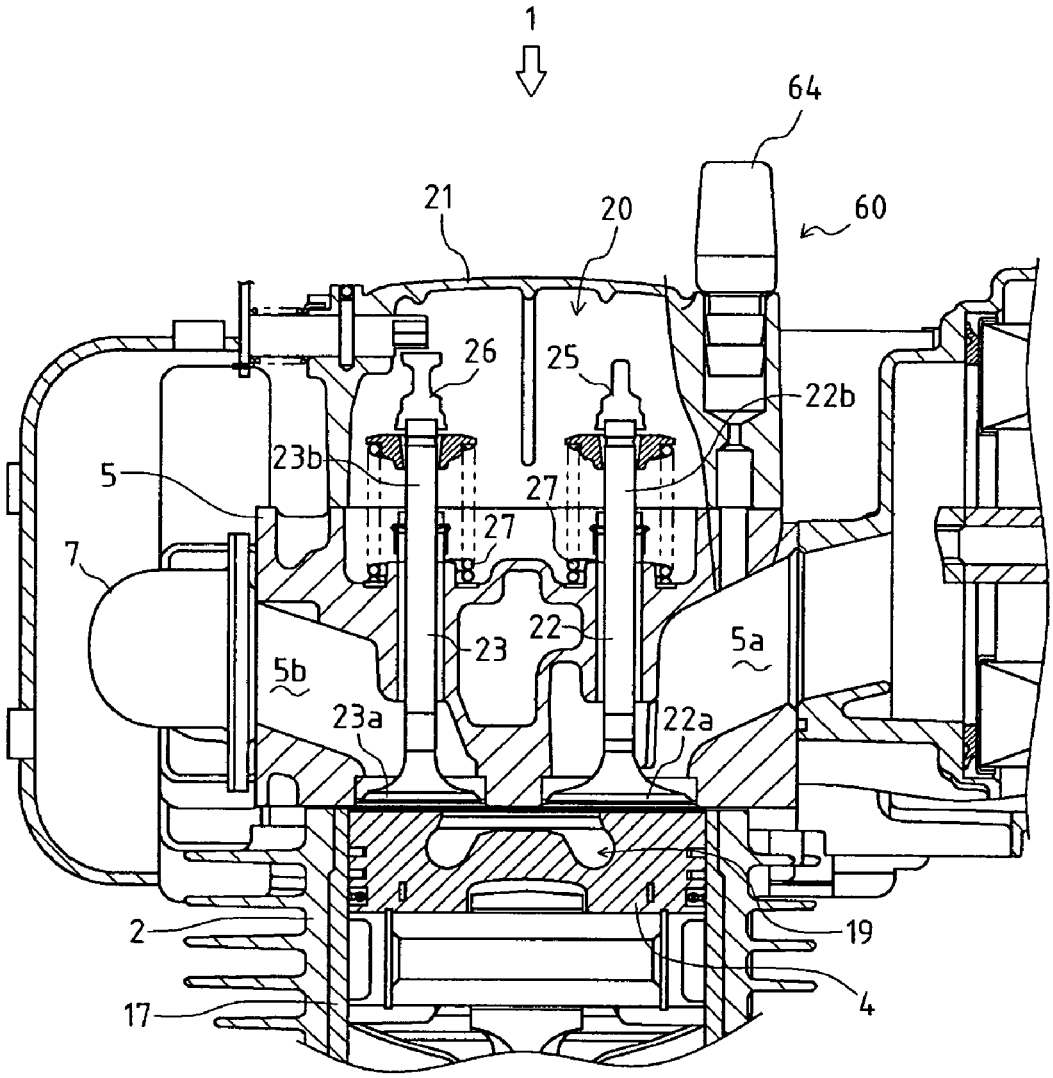
FIG. 3 is a sectional side view of the upper portion of the engine.

As shown in FIGS. 2 and 3, the intake valve 22 and the exhaust valve 23 are arranged above the piston 4. Valve heads 22*a* and 23*a* of the intake valve 22 and the exhaust valve 23 sit respectively on valve seats formed on the lower surface of the cylinder head 5, and are respectively arranged between the combustion chamber 19 and an intake port 5*a* or exhaust port 5*b* formed on the cylinder head 5. At the side of air intake of the cylinder head 5, an air cleaner 30 according to the present invention is provided. The intake port 5*a* is connected to the air cleaner 30 and the exhaust port 5*b* is connected to the muffler 8 through an exhaust manifold 7.

Valve stems 22*b* and 23*b* of the intake valve 22 and the exhaust valve 23 penetrate the cylinder head 5 upward and project into the rocker arm chamber 20. Springs 27 are attached respectively on the outsides of the valve stems 22*b* and 23*b* in the rocker arm chamber 20. The springs 27 respectively bias the intake valve 22 and the exhaust valve 23 so as to make them slide upward, whereby the intake valve 22 and the exhaust valve 23 are closed.

A flywheel 41*a* fixed to one of ends of the crankshaft 10 is disposed below the air cleaner 30, on one of side surfaces of the cylinder block 2. A plurality of fins 41*b* are fixed to the outer perimeter of the flywheel 41*a* and constitute a fan 41, and the fan 41 is covered by a fan casing 45. The fan 41 absorbs air into the fan casing 45 and sends it to the cylinder block 2 and the cylinder head 5 so as to cool them, and sends to the air cleaner 30 so as to make the air cleaner 30 absorb the air for combustion. The air for combustion is cleaned by the air cleaner 30 and absorbed by the intake port 5*a* of the cylinder head 5 so as to be supplied to the combustion chamber 19 through the intake valve 22 arranged below the intake port 5*a*.

Next, explanation will be given on the air cleaner 30 according to the present invention by referring to FIG. 4 in addition to the above drawings.

The air cleaner 30 comprises a main body 31, a cover body 32, an element 33 and the like. The cover body 32 is fixed to the main body 31 through a sealing member 34, and the element 33 is housed between the cover body 32 and the main body 31. Inside the main body 31, a step-like recess 31*c* is formed along the outer perimeter of the element 33. The element 33 is inserted into the recess 31*c* through a sealing member 39 and fastened by a stud bolt 35 and a nut 36 so as to be fixed to the main body 31. Then, the cover body 32 is fixed to the main body 31 by a nut 37.

Namely, on the inner surface of the main body 31, recesses 31*b*, 31*c* and 31*d* that the volume of the later of them is slightly larger than that of the former are formed step-like. The center recess 31*c* is formed its inner perimeter so as to be substantially in agreement with the outer perimeter of the element 33. Accordingly, by only engaging the element 33 with the recess 31*c*, the element 33 can be held so as not to fall down. The smallest recess 31*b* at the bottom side forms a space between the main body 31 and the element 33, and a suction hole 31*e* is formed at the center of the recess 31*b* as a passage through which air passes. The largest outer recess 31*d* forms a space between the outer perimeter of the element 33 and the inner surface of the main body 31 and the inside of the cover body 32 as a suction space.

Then, an internal thread part 31*f* is formed at the center of bottom of the main body 31 and the stud bolt 35 is screwed thereinto so as to insert the element 33 into the recess 31*c*. On the other hand, a cover 38 is provided outside the element 33 so as to be penetrated its center by the stud bolt 35, and then the element 33 is fixed by fastening the nut 36. Furthermore, the outer peripheral edge of the cover body 32 is engaged with the outer perimeter of the main body 31 so as to cover the element 33, and the stud bolt 35 penetrates a bolt hole opened at the center of the outside of the cover body 32, therefore the cover body 32 is fixed by fastening the nut 36 to the stud bolt 35.

Since the recess 31*c* is provided inside the main body 31 along the outer perimeter of the element 33 as the above, it is easily able to hold the element 33 by the recess 31*c* so as to position the element 33 before fastening the element 33 to the main body 31 by the stud bolt 35 and the nut 36. Accordingly, the element 33 can be prevented from being attached to a wrong position, and the air cleaner 30 can be assembled easily and quickly.

The air cleaner 30 is arranged above the fan casing 45, and a suction port 31*a* opening into the fan casing 45 is provided at the lower portion of the main body 31 constituting the air cleaner 30. Namely, the fan casing 45 is constructed so that the center portion thereof is set to a suction port, the outer perimeters of side and bottom portions thereof touch the cylinder block 2 and are closed, the top portion thereof is provided therein with an upward opening, and the perimeter of the top portion is closed by the main body 31 of the air cleaner 30. The lower portion of the air cleaner 30 and the upper portion of the fan casing 45 are communicated with each other through the suction port 31*a* so that cool air in the fan casing 45 is sucked into the air cleaner 30 through the suction port 31*a*.

According to this construction, the suction port of the fan casing 45 for outside air serves not only as an inlet for cooling air for the engine 1 but also as a suction port for combustion air to the air cleaner 30. Namely, for example, in the case that the engine 1 is arranged in a closed cabinet (the case of a soundproof engine), it is necessary to provide only one suction port, whereby the suction passage can be designed easily, and it is easy to set the suction port to a position through which the cleanest and coolest air can be supplied.

Since the air in the fan casing 45 can be guided directly to the air cleaner 30, the air intake system can be unified into a compact construction. Then, by guiding the air sucked into the fan casing 45 to the air cleaner 30, the air with little dust can be sucked into the air cleaner 30, thereby expanding the lifetime of the element 33. Namely, in the case that the engine is arranged at a position with much dust, if suction ports of a fan casing and an air cleaner are separated conventionally, each of the suction ports requires a filter and the filters must be exchanged frequently. However, by constructing according to the present invention, only one suction part is provided and it is also necessary to install only one filter, whereby the frequency of exchanging the element of the air cleaner 30 is reduced.

Furthermore, regardless whether a normal engine or a soundproof engine is disposed, the common air cleaner can be used, whereby the variety of the air cleaner can be reduced so as to reduce the cost.

Figure 5:
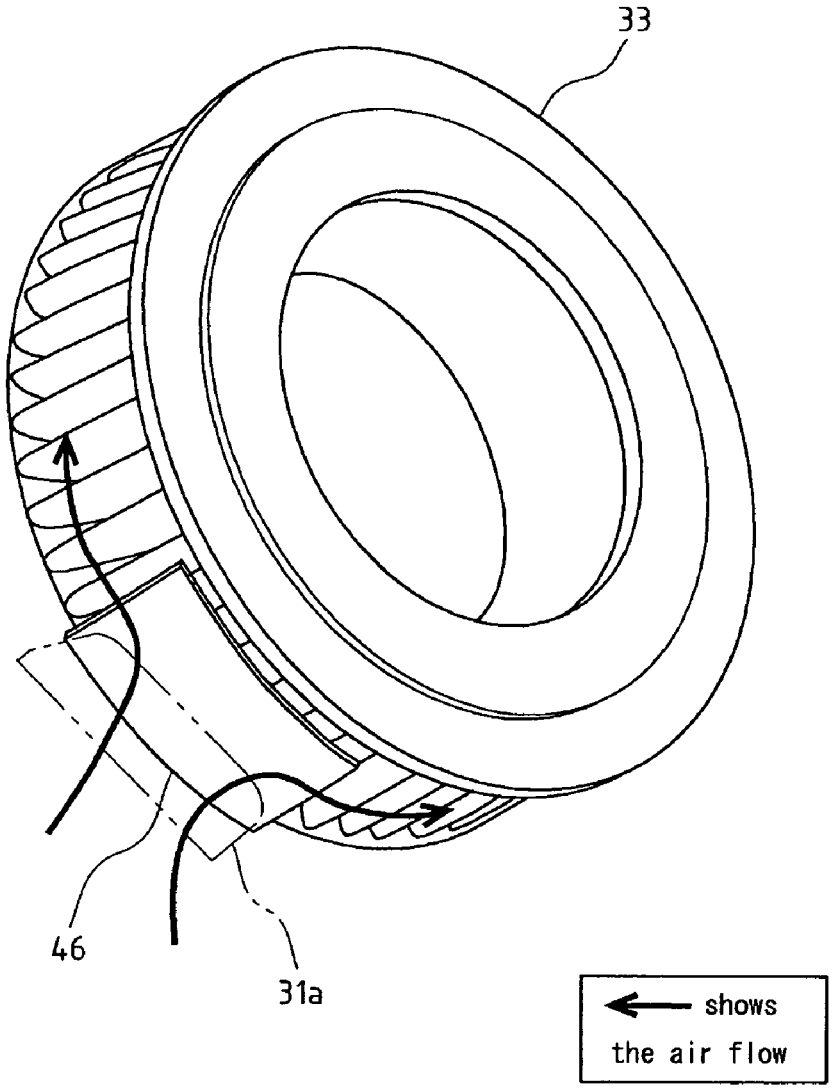
FIG. 5 is a perspective view of a barrier in the air cleaner.

As shown in FIG. 5, in the air cleaner 30, a barrier 46 is provided at a position facing to the suction port 31*a*. The barrier 46 is disposed between the suction port 31*a* and the element 33. Namely, air sucked through the suction port 31*a* strikes against the barrier 46 and is dispersed so as not to strike directly against the element 33 facing to the suction port 31*a* but to be guided to be spread over the element 33.

With regard to the conventional air cleaner, air tends to be sucked into only a part facing to the suction port of the element so that the element is partially degraded early, whereby the interval for exchanging the element is shortened. However, by providing the barrier 46 at the position facing to the suction port 31*a* according to the present invention, the inclination of air suction to the element can be prevented. Accordingly, it is prevented that a part of the element 33 is only obstructed or that a part of the element 33 is only degraded, thereby expanding the lifetime of the element. In addition, the barrier 46 is larger than the suction port 31*a*, constructed to be curved concentrically with the element 33, and is disposed outside the element 33.

Next, explanation will be given on the construction of the main body 31 of the air cleaner 30.

Figure 6:
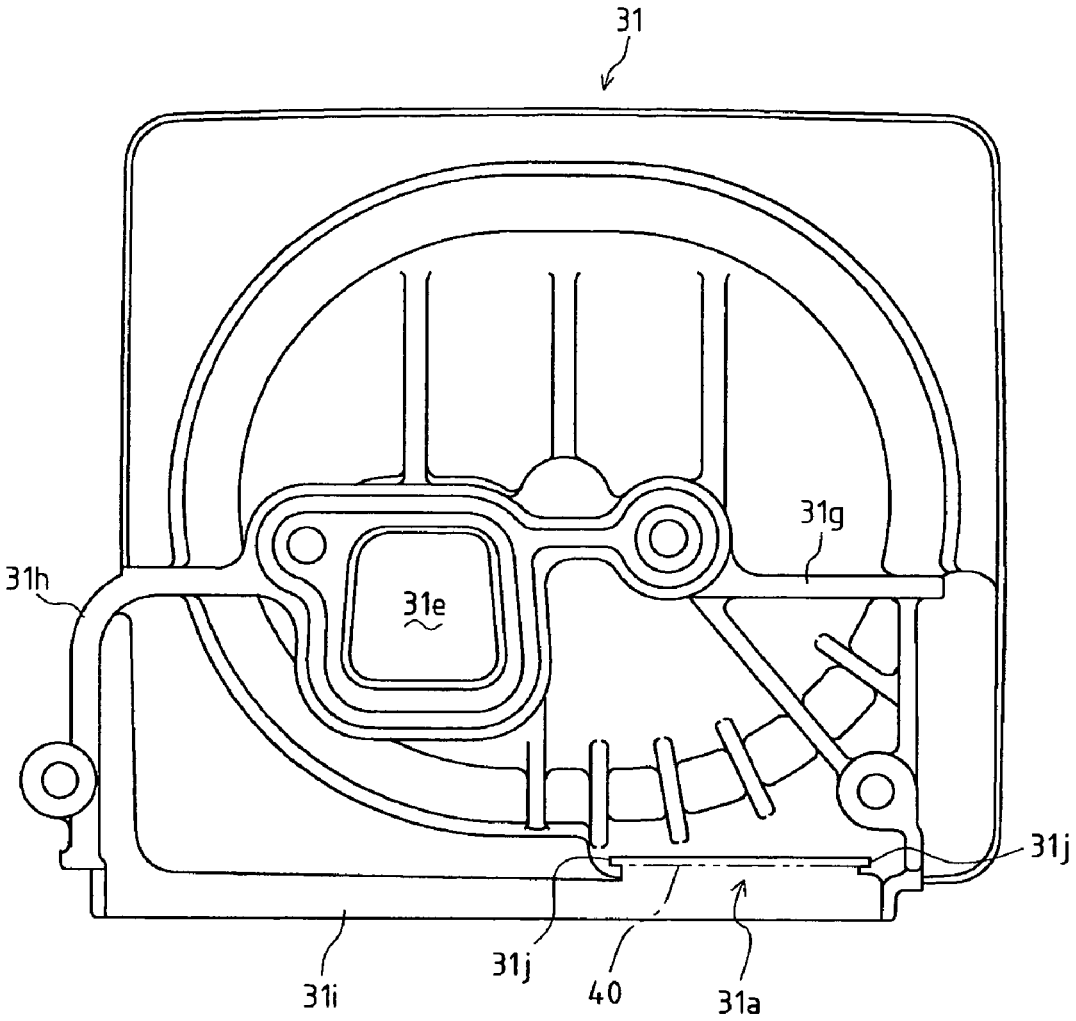
FIG. 6 is a rear view of the air cleaner.
Figure 7:
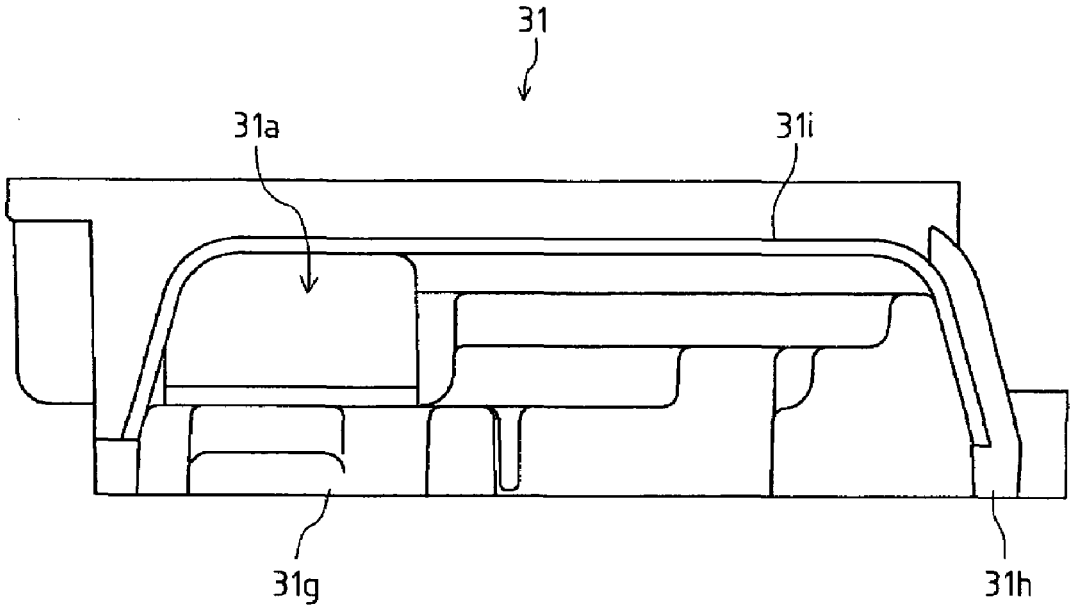
FIG. 7 is a bottom view of the air cleaner.

As shown in FIGS. 6 and 7, walls discussed below are integrally formed on the main body 31 of the air cleaner 30. At the side of the cylinder head 5, a wall 31*g* extended outward (toward the cylinder head 5) from the vertical middle portion of the main body 31, a wall 31*h* connected to the wall 31*g*, and a wall 31*i* extended downward (toward the fan casing 45) from the bottom of the main body 31 at the side opposite to the cylinder head to be substantially U-like shaped. These walls 31*g*, 31*h* and 31*i* guide the air from the fan 41 through the upper portion of the fan casing 45 to the cylinder head 5. Accordingly, the walls 31*g*, 31*h* and 31*i* are constructed integrally with the main body 31 so as to serve as baffles, therefore it is not necessary to provide any baffle so as to guide air from the fan 41 to the cylinder head 5, thereby reducing the cost. In addition, bolt holes for attaching the main body 31 to the cylinder head 5 are formed in the walls 31*g* and 31*h*.

Instead of sucking the air in the fan casing 45 according to the position of the engine 1, the air cleaner 30 may alternatively be constructed that an air intake part is formed in the cover body 32 so that outside air is sucked through the air intake part.

Namely, as shown in FIG. 6, a groove 31*j* hollow when viewed from back is formed at the edge of the suction port 31*a* of the main body 31 so as to be U-like shaped in plan. The groove 31*j* is opened toward the cylinder head and is horizontal over the longitudinal width of the suction port 31*a*. A shutter 40 slightly larger than the suction port 31*a* can be slidably inserted into the groove 31*j* outward from the side of the cylinder head 5. Accordingly, by inserting and sliding the shutter 40 into the groove 31*j* at need, the suction port 31*a* can be closed so as to intercept air sucked from the fan casing 45 to the air cleaner 30.

Figure 8:
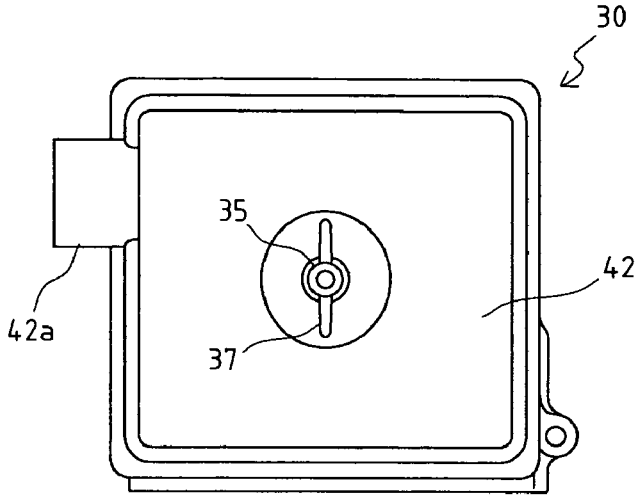
FIG. 8 is a front view of a cover body of the air cleaner. (a) is a front view in which an air intake part is provided on the left side surface of the cover body. (b) is a front view in which the air intake part is provided on the right side surface of the cover body.
Figure 8:
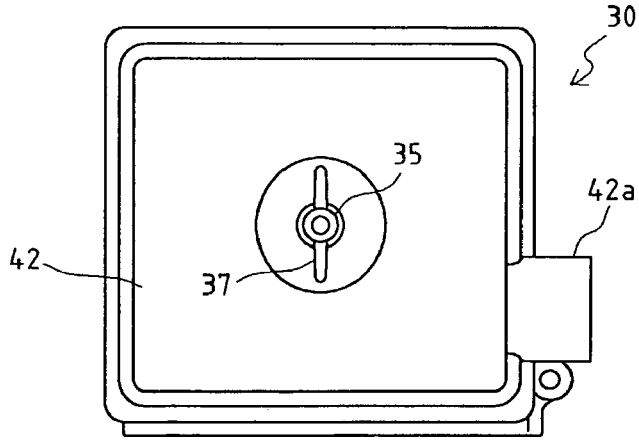
Figure 9:
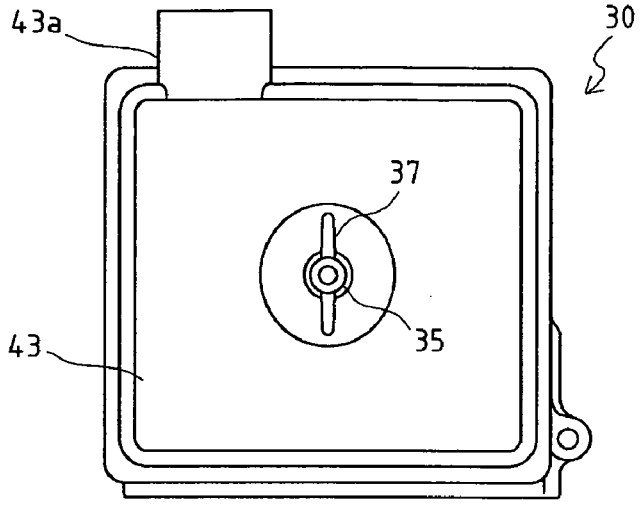
FIG. 9 is a front view of a cover body of the air cleaner. (a) is a front view in which the air intake part is provided on the upper surface of the cover body. (b) is a front view in which the air intake part is provided on the lower surface of the cover body.
Figure 9:
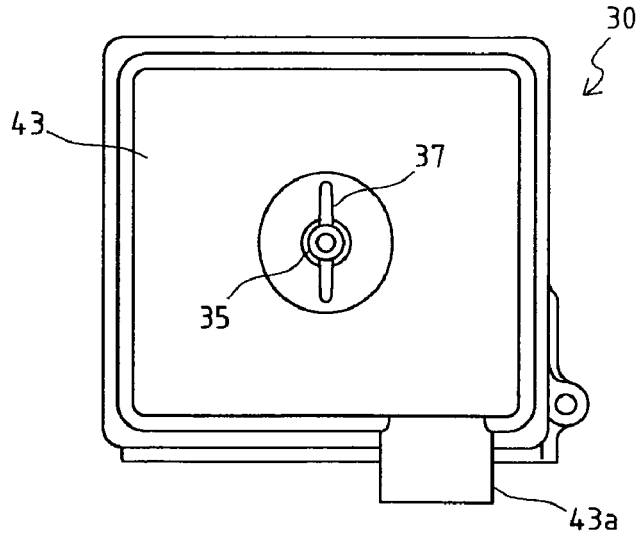

The air intake part formed in the cover body 32 of the air cleaner 30 is constructed as shown in FIG. 8 or 9 for example. Namely, by exchanging the cover body 32 for a cover body 42 (in FIG. 8) or 43 (in FIG. 9) provided its side portion with an air intake part 42*a* or 43*a*, outside air can be sucked directly into the air cleaner 30. Each of the air intake parts 42*a* and 43*a* of the cover bodies 42 and 43 is provided close to one of vertical or lateral sides of one side surface of the cover bodies 42 and 43. For example, with regard to the cover body 42 shown in FIG. 8, the nut 37 is removed so as to remove the cover body 42 and then rotate the cover body 42 for 180° so as to change the attachment direction from the state shown in FIG. 8 (*a*), the direction of the air intake part 42*a* can be changed laterally inversely as shown in FIG. 8 (*b*). Similarly, with regard to the cover body 43 shown in FIG. 9, by rotating the cover body 43 for 180° so as to change the attachment direction from the state shown in FIG. 9 (*a*), the direction of the air intake part 43*a* can be changed vertically inversely as shown in FIG. 9 (*b*).

Accordingly, by constructing that the cover body 42 or 43 is formed to be an equilateral polygon (n-gon) when viewed in front (viewed from the right side in FIG. 4), the center portion thereof is enabled to be fixed by the stud bolt 35 and the nut 37, and the air intake part is provided at one side of the cover body, the attachment direction of the cover body can be changed by rotating the cover body for fixed degree (360/n°). Therefore, the direction of the air intake part can be changed. Since the direction of the air intake part can be changed inversely by changing the attachment direction of the cover body, the spec of the engine can be changed easily. With regard to this embodiment, the cover body is formed to be square, and so the direction of sucking outside air can be rotated for every 90° by rotating the cover body for every 90°.

Figure 4:
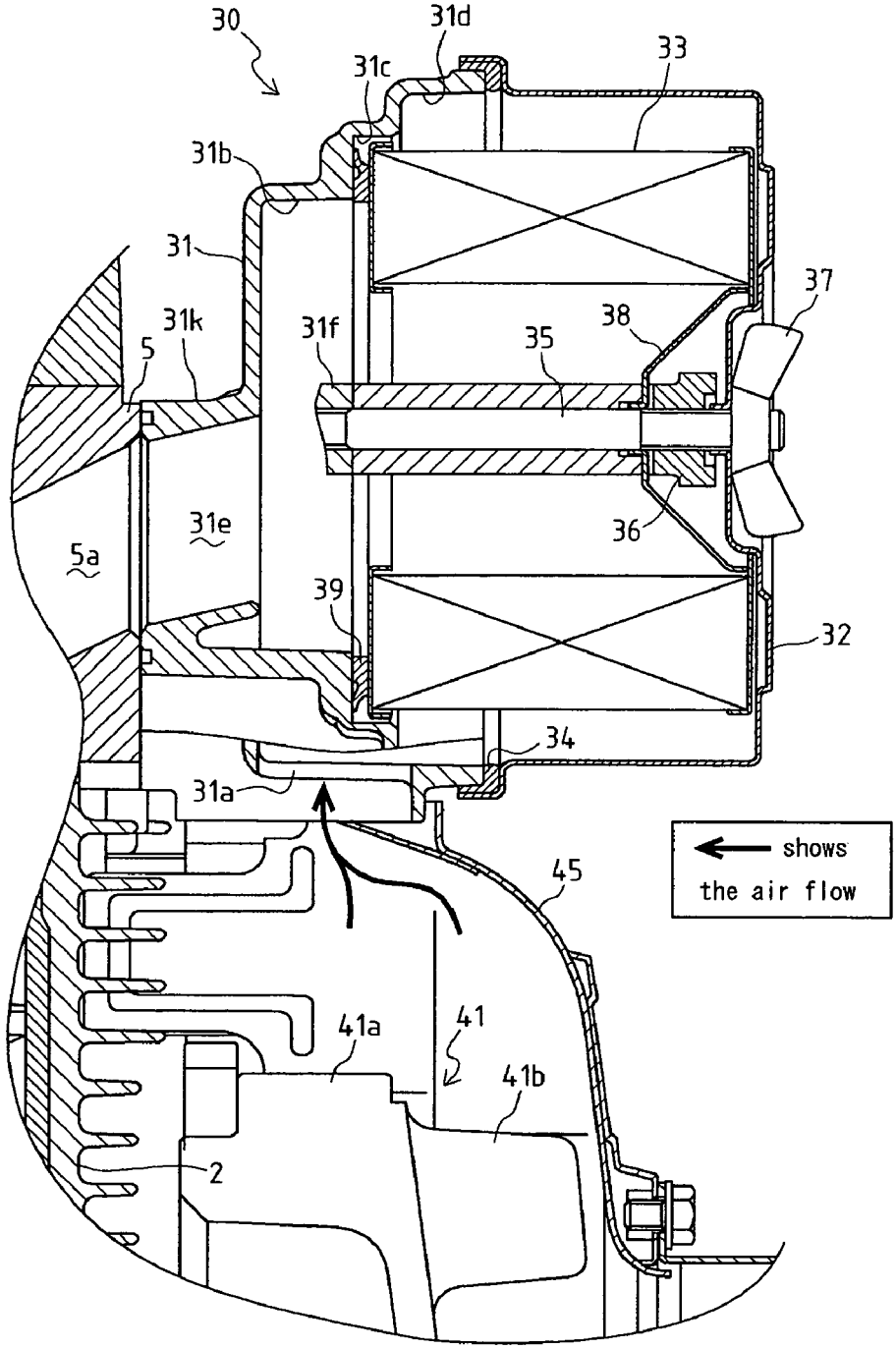
FIG. 4 is a sectional side view of an air cleaner.

As shown in FIG. 4, an intake pipe 31*k* extended toward the cylinder head 5 is formed integrally on the rear portion (the side of the element 33, the left side in FIG. 4) of the main body 31, that is, on the substantial center portion of the main body 31 at the side of the cylinder head 5. The tip of the intake pipe 31*k* is enabled to be connected to the intake port 5*a* of the cylinder head 5 so as to communicate the intake pipe 31*k* with the intake port 5*a*. Accordingly, the air cleaner 30 is communicated with the intake port 5*a* so as to form a suction passage from the air cleaner 30 to the intake port 5*a*. In addition, the outer peripheral surface of the intake pipe 31*k* constitutes a part of the wall 31*g*.

Since the intake pipe 31*k* is constructed integrally with the main body 31 of the air cleaner 30 as the above, it is not necessary to attach an intake pipe to an air cleaner conventionally, whereby the part number can be reduced so as to reduce the cost. Furthermore, the main body 31 including the intake pipe 31*k* can be manufactured easily by die casting or injection molding, thereby reducing the cost. Moreover, the width (in the direction of the intake pipe) of the main body 31 can be shortened. Accordingly, in the case of constructing the air cleaner 30 in the size similar to the conventional one, the element 33 can be enlarged for the shortening of the main body 31, thereby expanding the lifetime of the element 33.

Furthermore, the main body 31 is formed by a two-part mold, and the two molds are adhered to each other at the part of the suction hole so as to make the suction port 31*a*, provided in the main body 31, perpendicular to the draft direction of the mold. Accordingly, the main body 31 can be formed easily by aluminum die casting. The suction port 31*a* can be formed simultaneously with the main body 31 by the mold, whereby the boring work is omitted so as to reduce the cost.

The suction hole 31*e* penetrated and opened in the intake pipe 31*k* is formed to be an extension of the intake port 5*a*. Namely, with regard to the sectional side shape of the suction hole 31*e* and the intake port 5*a*, the slant of the upper and lower inner walls of the intake port 5*a* is in agreement with the slant of the upper and lower inner walls of the suction hole 31*e*, and the sectional front shapes thereof are also in agreement with each other. Accordingly, no step exists in the suction passage from the suction hole 31*e* to the intake port 5*a*. Therefore, the air flow from the air cleaner 30 through the suction hole 31*e* to the intake port 5*a* is smooth and turbulence is prevented from being generated in the suction passage so as to supply air from the air cleaner 30 to the intake port 5*a* stably. Accordingly, resistance of air, introduced from the intake port 5*a*, in the suction passage is made small so as to promote swirls formed at the time that the air flows from the valve hole of the intake valve 22 into the cylinder 2*a*.

With regard to a diesel engine such as the engine 1 according to the present invention especially, it is necessary to mix air and fuel well so as to make the fuel combust completely in a short time. Accordingly, the engine is designed so that swirls of air, mixture and combustion gas are generated in the combustion chamber.

Especially, the intake port is formed consciously of the generation of swirls. For generating strong swirls without disturbing the air flow as much as possible, the intake port is provided eccentrically to the combustion chamber, or the shape of the valve is contrived. Then, with regard to the present invention, for promoting the generation of swirls, the shape of the intake port 5*a* formed in the cylinder head 5 is also contrived.

Figure 10:
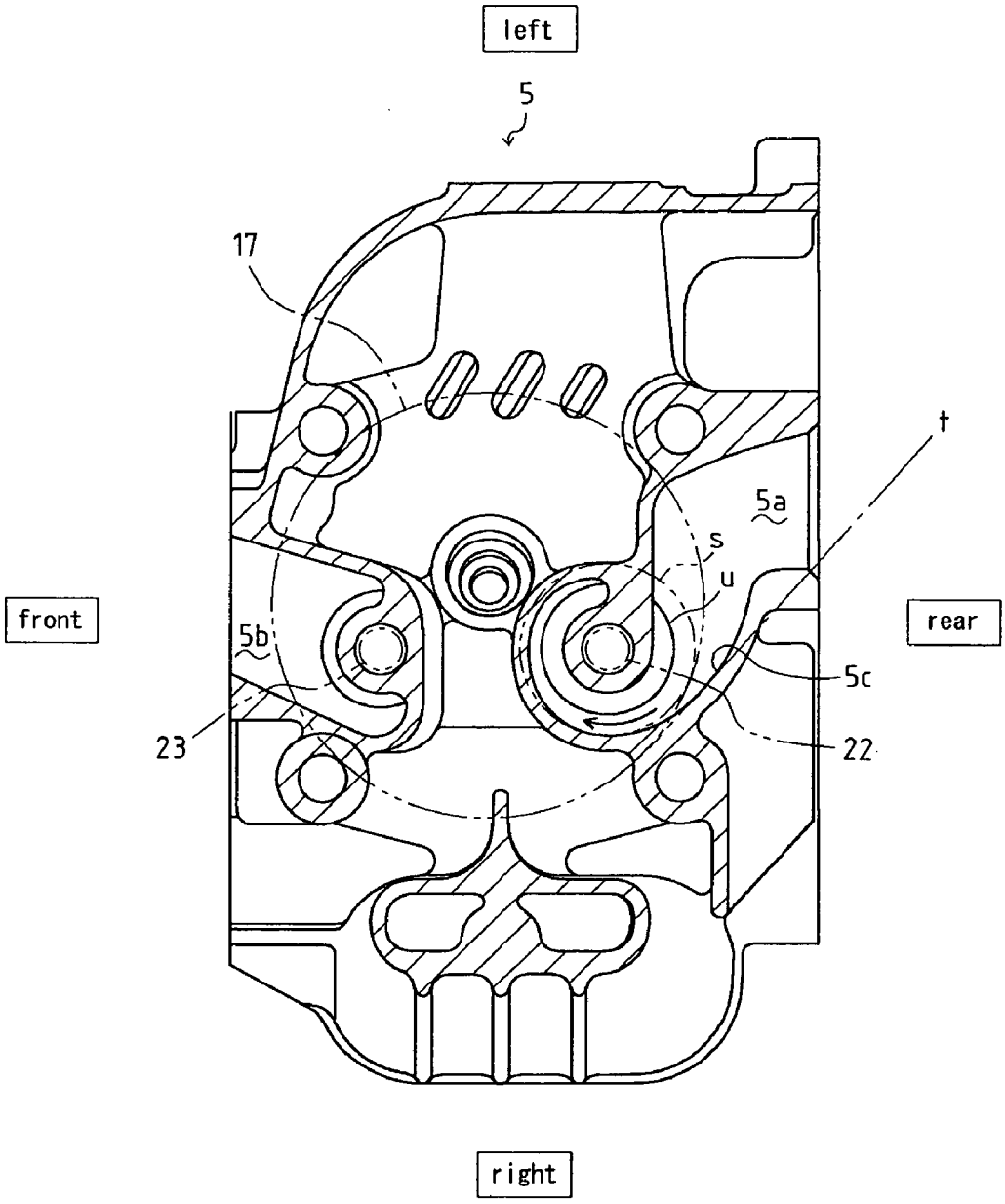
FIG. 10 is a sectional plan view of a cylinder head.
Figure 11:
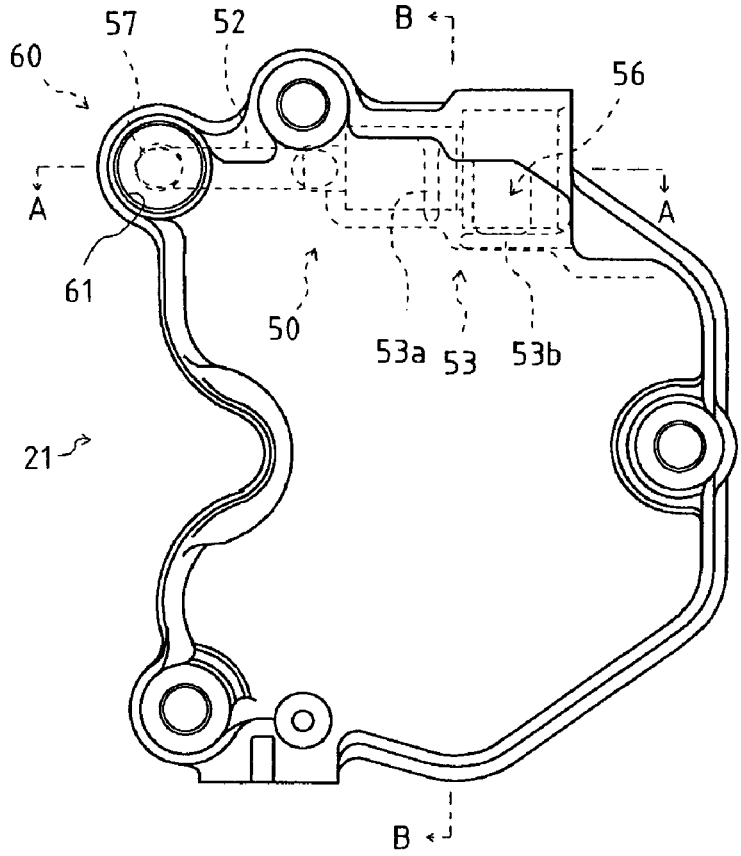
FIG. 11 is a plan view of a rocker arm casing.
Figure 12:
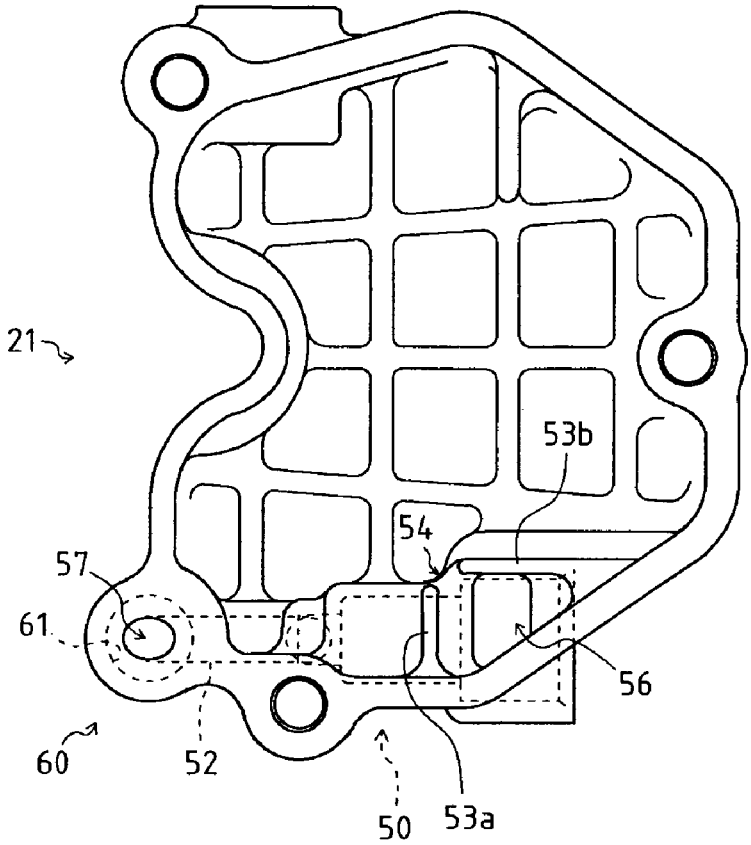
FIG. 12 is a bottom view of the rocker arm casing.

As shown in FIG. 10, the intake valve 22 and the exhaust valve 23 are arranged in the cylinder head 5 longitudinally when viewed in sectional plan, and the intake valve 22 and the exhaust valve 23 are arranged eccentrically rightward against the center of the cylinder 2*a*. In this case, with regard to the relation of position between the intake valve 22 and the exhaust valve 23 and the intake port 5*a*, the intake of the intake port 5*a* is arranged opposite laterally to the intake valve 22 against the cylinder liner 17 (in this embodiment, at the left side on the lateral direction of the vehicle (upper side in the drawing). Then, the shape of the intake port 5*a* formed in the cylinder head 5 is formed from the left side and bent rightward so as to be a spiral passage toward the center of the intake valve 22 disposed below the intake port 5*a*. The sectional shape in plan of the outer portion of the passage, that is, an inner wall (inner surface) 5*c* of the outside of the intake port 5*a* is formed close along the direction of the tangential line t of the inner perimeter of the cylinder liner 17. In other words, the shape of the inner wall 5*c* of the outside of the intake port 5*a* is as close as possible to the arc shape of the cylinder liner 17 and is smooth from the inlet of the intake port 5*a* to the point just before intersecting the inner perimeter of the cylinder liner 17. Then, the shape of the inner wall 5*c* after intersecting the inner perimeter of the cylinder liner 17 is connected to the outer circle s of the intake valve 22 smoothly when viewed in plan. Furthermore, by forming the inner wall 5*c* to be a parabolic curve smoothly connected to the outer perimeter u of the valve hole opened/closed by the intake valve 22, the whole inner wall 5*c* forms a spiral curve. Moreover, the intake port 5*a* is arranged in the cylinder head 5 as a shape having the intake with enough width for sucking air.

According to the above shape and arrangement of the intake port 5*a*, the resistance of air flowing into the intake port 5*a* from the outside becomes smallest, whereby the flow velocity of the outside air becomes fast. Therefore, the difference of flow velocity of sucked air between the inside and outside of the intake port 5*a* becomes large so that the swirls of air flow tend to be generated. Namely, according to the shape of the intake port 5*a* as the above, the above-mentioned swirls tend to be generated, whereby air and fuel are mixed well so as to promote the combustion.

Next, explanation will be given on the breather 50 according to the present invention by referring to FIGS. 11 to 14.

As mentioned above, in the rocker arm chamber 20 above the cylinder head 5, the breather 50, which adjusts the difference of pressure between the rocker arm chamber 20 and the outside, is provided integrally with the rocker arm casing 21 at the side of the intake port 5*a* (in this embodiment, the right side in FIG. 3) in the upper portion of the rocker arm casing 21.

The breather 50 is communicated with outside air so as to prevent the pressure in the rocker arm chamber 20 from being high or low. A part of the breather 50 is constructed that air is vented through a check valve 51, which is provided integrally with the rocker arm casing 21 and prevents a back flow, and the vented air passes through a breather reflux passage 52 and is discharged through an exhaust port 57 formed in the rocker arm casing 21, and then returns to the intake port 5*a* through a passage 44 formed in the cylinder head 5.

In the rocker arm chamber 20, lubricating oil scatters so as to lubricate the upper ends of the intake valve 22 and the exhaust valve 23, rocker arms 25 and 26 and the like. For returning the mist-like lubricating oil into the crankcase 3 as a liquid, a baffle 53 is provided integrally with the rocker arm casing 21 around an air hole 56 as an inlet of the breather 50. Namely, by providing the baffle 53, when the pressure in the rocker arm chamber 20 is vent by the breather 50, the mist-like lubricating oil strikes against and adheres to the baffle 53 at the time that high-pressure air in the rocker arm chamber 20 enters the air hole 56, and the lubricating oil adhering to the baffle 53 grows from small drops to a liquid and drips, and then returns to the crankcase 3 through a push rod chamber or the like.

If a baffle functioning as the above is provided over around the lower portion of the air hole 56, at the time that much lubricating oil is accumulated in the rocker arm chamber 20 or that the main body is slanted so as to raise the oil surface, the baffle may serve like a straw so as to suck the lubricating oil up. Then, the baffle 53 comprises boards 53*a* and 53*b*. The boards 53*a* and 53*b* are formed integrally with the rocker arm casing 21 substantially vertically so that a space is leaved between the tips thereof, and the boards 53*a* and 53*b* are projected around the air hole 56 communicated with the check valve 51. Namely, a vertical slit 54 opening downward is provided between the boards 53*a* and 53*b*. However, the vertical slit 54 may alternatively be provided between the board 53*a* or 53*b* and the side wall of the rocker arm casing 21.

Figure 13:
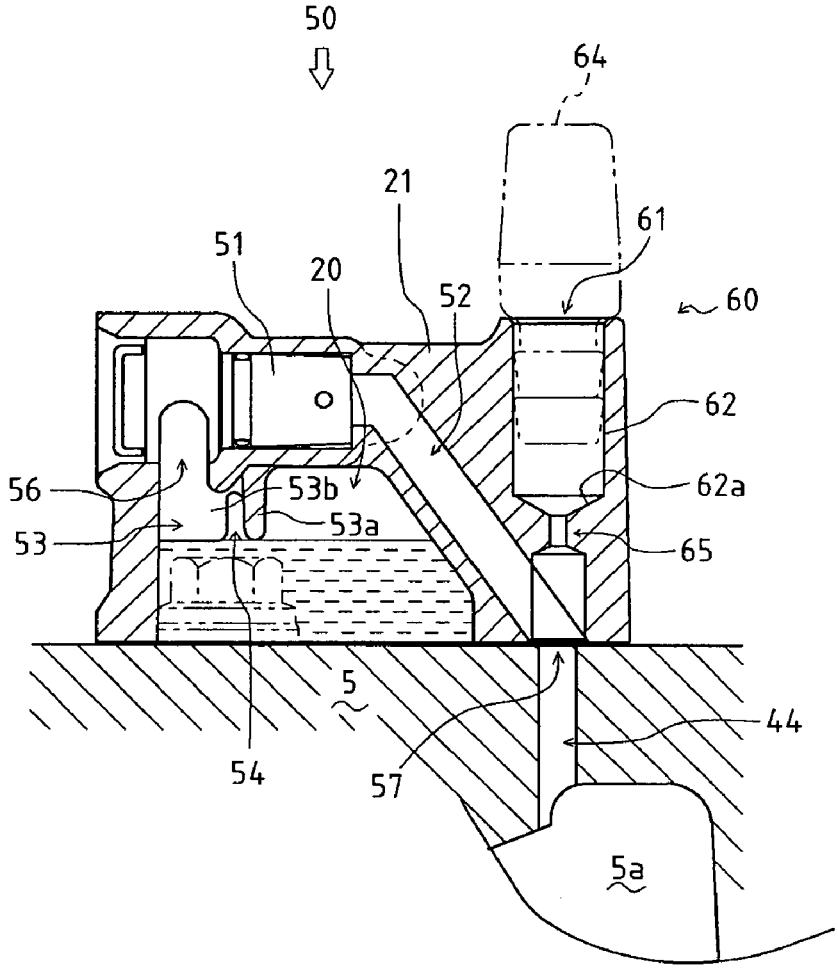
FIG. 13 is an arrow sectional view of the line A—A in FIG. 11.
Figure 14:
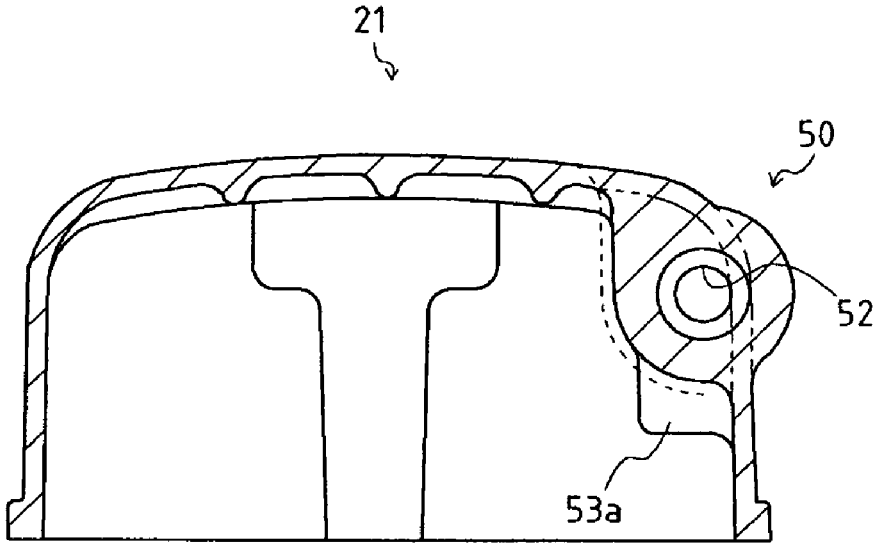
FIG. 14 is an arrow sectional view of the line B—B in FIG. 11.

Accordingly, by providing the slit 54 in the baffle 53, as shown in FIG. 13, even if the surface of lubricating oil rises to the vicinity of the baffle 53, the engine 1 vibrates, or lubricating oil accumulated in the rocker arm chamber 20 reaches the lower end of the baffle by the vibration of the engine 1 mounted on a vehicle, air can be vented through the slit 54, thereby preventing the lubricating oil accumulated in the rocker arm chamber 20 from sucked to the check valve 51. Namely, unless the rocker arm chamber 20 is filled with lubricating oil, the lubricating oil is prevented from entering the check valve 51. Accordingly, the generation of exhaust emission, caused by the lubricating oil, is prevented, thereby improving exhaust ability. The slit 54 can be formed easily, whereby the above-mentioned effect can be obtained with a simple construction without providing a cavity by drilling instead of the slit 54.

Then, explanation will be given on a construction of a starting adjuvant injection part 60 according to the present invention.

The starting adjuvant injection part 60 injects oil which is a starting adjuvant for starting the engine smoothly at a low temperature, and is provided integrally with the rocker arm casing 21 at one end of the rocker arm casing 21 as shown in FIGS. 3 and 11 to 13.

The starting adjuvant injection part 60 is communicated with the intake port 5*a*, and oil injected through an inlet 61 for starting adjuvant passes through the passage 44 formed in the cylinder head 5 and an injection passage 62 penetrating the starting adjuvant injection part 60, and drips to the intake port 5*a* and enters the combustion chamber 19 through the intake port 5*a*. Accordingly, the volume in the combustion chamber 19 is reduced for the dripping oil and the compression ratio of mixed gas is raised, whereby the engine becomes easy to start. In addition, except at the time of injecting the starting adjuvant, a cap 64 is inserted into the inlet 61 so as to prevent contamination from the outside.

A sump 62*a* and a throttle 65 are formed in the middle of the injection passage 62 for preventing that oil exceeding a fixed amount is injected into the combustion chamber 19 and the pressure becomes excessively high so as to cause oil hammer. Namely, by providing the throttle 65 in the middle of the injection passage 62 accordingly, oil injected through the inlet 61 is accumulated in the funnel-like sump 62*a*, formed in the injection passage 62, once before entering the throttle 65, and then drips gradually by proper quantities.

According to this construction, at the time of injecting oil as a starting adjuvant, the injection amount of the starting adjuvant is limited automatically by the throttle 65 provided in the injection passage 62 thereby preventing excessive injection. The injection amount of the starting adjuvant is limited and the starting adjuvant is injected gradually, therefore even a general user can inject the starting adjuvant while checking the amount by eye, thereby preventing that much oil is sucked into the combustion chamber 19 at once so as to cause overrun or oil hammer.

Furthermore, the breather reflux passage 52 and the injection passage 62 for starting adjuvant have the common exhaust port 57 formed in the rocker arm casing 21. Namely, the breather 50 and the starting adjuvant injection part 60 are provided at the side of the intake port 5*a* (the upper side in FIG. 11) in the rocker arm casing 21, and the breather reflux passage 52 and the injection passage 62 are constructed integrally with the rocker arm casing 21 and communicated with one exhaust port 57.

According to this construction, the breather 50 and the starting adjuvant injection part 60 are arranged intensively in the rocker arm casing 21, whereby part number is reduced so as to reduce the cost and to simplify the processing and the space is saved.

INDUSTRIAL APPLICABILITY

As the above mentioned, the superstructure of the engine according to the present invention is widely applicable to an engine comprises an air cleaner cleaning air supplied to a combustion chamber of the engine, or an engine comprises a breather and a starting adjuvant injection part, which injects a starting adjuvant for starting the engine smoothly at a low temperature, in an upper portion of a rocker arm casing.

What is claimed is:

1. A superstructure of an engine comprising:

a fan provided at one side of the engine and covered by a fan casing;

an air cleaner arranged near the fan casing;

a suction port opening into the fan casing provided in a main body of the air cleaner;

a rocker arm chamber;

a breather in an upper portion of the rocker arm chamber;

a baffle provided around an air hole of the breather in the rocker arm casing; and a slit provided so as to open a lower portion of the baffle.

2. The superstructure of the engine as set forth in claim 1, wherein a barrier is provided at a position facing to the suction port so as to disperse sucked air.

3. The superstructure of the engine as set forth in claim 1, wherein the air cleaner is arranged at a side of a cylinder head and a wall standing toward the cylinder head is formed on an outer surface of the main body of the air cleaner.

4. The superstructure of an engine as set forth in claim 1, wherein the air cleaner is constructed by housing an air cleaning element by the main body and a cover body, and wherein a recess along an outer perimeter of the element is formed on an inner surface of the main body.

5. The superstructure of an engine as set forth in claim 1, wherein the air cleaner is constructed by housing an cleaning element by the main body and a cover body, and wherein an air intake part is provided on one of side surfaces of the cover body and the cover body is constructed to be an equilateral polygon.

6. The superstructure of an engine as set forth in claim 1, wherein the air cleaner is attached to an intake port of a cylinder head of the engine, and wherein an intake pipe communicated with the intake port is constructed integrally with a main body of the air cleaner.

7. The superstructure of the engine as set forth in claim 6, wherein a suction port, communicated with an inside of a fan casing positioned near the air cleaner, is provided in the main body.

8. The superstructure of the engine as set forth in claim 6, wherein a wall standing toward a fan casing positioned near the air cleaner and the engine is formed on an outer surface of the main body of the air cleaner.

9. The superstructure of the engine as set forth in claim 6, wherein the main body is formed by a two-part mold, and a suction hole provided in the main body is formed perpendicular to draft direction of the mold by adhering two molds with each other.

10. The superstructure of the engine as set forth in claim 6, wherein a suction hole of intake pipe is formed to be an extension of the intake port of the cylinder head.

11. The superstructure of an engine as set forth in claim 1, wherein air is sucked into an intake port provided in a cylinder head covering an upper portion of a cylinder block, wherein the air is supplied through an intake valve arranged below the intake port in the cylinder head to a combustion chamber, and wherein an inner surface of an outside of the intake port is formed close along a direction of a tangential line of an inner perimeter of a cylinder liner of the cylinder block when viewed in plan.

12. The superstructure of the engine as set forth in claim 1, wherein a reflux passage of the breather and a starting adjuvant injection passage are constructed integrally with a rocker arm casing of the rocker arm chamber.

13. A superstructure of an engine comprising:

a fan provided at one side of the engine and covered by a fan casing;

an air cleaner arranged near the fan casing;

a suction port opening into the fan casing provided in a main body of the air cleaner;

a breather in an upper portion of a rocker arm chamber;

a reflux passage of the breather and a starting adjuvant injection passage communicated with each other; and a throttle provided in the starting adjuvant injection passage.

14. The superstructure of the engine as set forth in claim 13, wherein the reflux passage and the starting adjuvant injection passage are constructed integrally with a rocker arm casing of the rocker arm chamber.

15. The superstructure of an engine according to claim 13, wherein air is sucked into an intake port provided in a cylinder head covering an upper portion of a cylinder block, wherein the air is supplied through an intake valve arranged below the intake port in the cylinder head to a combustion chamber, and wherein an inner surface of an outside of the intake port is formed close along a direction of a tangential line of an inner perimeter of a cylinder liner of the cylinder block when viewed in plan.

16. The superstructure of the engine as set forth in claim 13, wherein a barrier is provided at a position facing to the suction port so as to disperse sucked air.

17. The superstructure of the engine as set forth in claim 13, wherein the air cleaner is arranged at a side of a cylinder head and a wall standing toward the cylinder head is formed on an outer surface of the main body of the air cleaner.

18. The superstructure of an engine as set forth in claim 13, wherein the air cleaner is constructed by housing an air cleaning element by the main body and a cover body, and wherein a recess along an outer perimeter of the element is formed on an inner surface of the main body.

19. The superstructure of an engine as set forth in claim 13, wherein the air cleaner is constructed by housing an air cleaning element by the main body and a cover body, and wherein an air intake part is provided on one of side surfaces of the cover body and the cover body is constructed to be an equilateral polygon.

20. The superstructure of an engine as set forth in claim 13, wherein the air cleaner is attached to an intake port of a cylinder head of the engine, and wherein an intake pipe communicated with the intake port is constructed integrally with a main body of the air cleaner.

21. The superstructure of the engine as set forth in claim 20, wherein a suction port, communicated with an inside of a fan casing positioned near the air cleaner, is provided in the main body.

22. The superstructure of the engine as set forth in claim 20, wherein a wall standing toward a fan casing positioned near the air cleaner and the engine is formed on an outer surface of the main body of the air cleaner.

23. The superstructure of the engine as set forth in claim 20, wherein the main body is formed by a two-part mold, and a suction hole provided in the main body is formed perpendicular to draft direction of the mold by adhering two molds with each other.

24. The superstructure of the engine as set forth in claim 20, wherein a suction hole of intake pipe is formed to be an extension of the intake port of the cylinder head.

* * * * *